United States Patent [19]

Hayakawa et al.

[11] Patent Number: 5,057,391

[45] Date of Patent: Oct. 15, 1991

[54] PHOTOSENSITIVE MEMBER FOR ELECTROPHOTOGRAPHY AND PROCESS FOR MAKING USING ELECTRON CYCLOTRON RESONANCE

[75] Inventors: Takashi Hayakawa, Nara; Shiro Narikawa, Kashihara; Kunio Ohashi, Nara; Yoshiharu Tsujimoto, Yamatokoriyama, all of Japan

[73] Assignee: Sharp Kabushiki Kaisha, Osaka, Japan

[21] Appl. No.: 523,242

[22] Filed: May 15, 1990

[30] Foreign Application Priority Data

May 16, 1989 [JP] Japan ..... 54-124042

[51] Int. Cl.[5] ..... G03G 5/82; G03G 5/14

[52] U.S. Cl. ..... 430/66; 430/130; 430/134

[58] Field of Search ..... 430/66, 58, 59, 130, 430/134

[56] References Cited

U.S. PATENT DOCUMENTS

| | | | |
|---|---|---|---|
| 4,760,008 | 7/1988 | Yamazaki et al. | 430/127 |
| 4,818,651 | 4/1989 | Shirai et al. | 430/64 |
| 4,859,554 | 8/1989 | Yamazaki et al. | 430/66 |

*Primary Examiner*—David Welsh
*Assistant Examiner*—S. Rosasco
*Attorney, Agent, or Firm*—Nixon & Vanderhye

[57] ABSTRACT

A photosensitive member for electrophotography comprising a photoconductive layer formed on an electroconductive support, in which the photoconductive layer is composed of an amorphous silicon germanium layer formed by electron cyclotron resonance (ECR) method and containing hydrogen and/or halogen in an amount of more than 40 at. % to 65 at. % and an amorphous silicon nitride layer formed by ECR method and containing hydrogen and/or halogen in an amount of more than 40 at. % to 60 at. %, the amorphous silicon nitride layer being laminated on the amorphous silicon germanium layer; said member exhibiting an increased sensitivity to laser rays having a long wavelength and an improved charge retention capacity.

30 Claims, 9 Drawing Sheets

PHOTOSENSITIVE MEMBER FOR ELECTROPHOTOGRAPHY AND PROCESS FOR MAKING USING ELECTRON CYCLOTRON RESONANCE

BACKGROUND OF THE INVENTION

1. Field of the Invention

The present invention relates to a photosensitive member for electrophotography, which is used in an image-forming device for forming images by electrophotography and, in particular, to a photosensitive member in a laser printer or the like device to be driven with a light source of a semiconductor laser. 2. Description of the Related Art Recently, a photosensitive member having a germanium-containing amorphous silicon (hereinafter referred to as "a-SiGe") layer as a photoconductive layer or that having a laminate layer composed of amorphous silicon (hereinafter referred to as "a-Si") and a-SiGe as a photoconductive layer is being desired to be put into practical use as a photosensitive member in a laser printer or the like device to be driven with a light source of a semiconductor laser, because of the following advantageous merits:

(1) The member has a long life.

(2) The member is non-toxic to human bodies.

(3) The member is highly sensitive to lights having a long wavelength.

In the photosensitive member having the above-mentioned constitution, both the a-SiGe layer and the a-Si layer are formed by a so-called plasma CVD method (p-CVD) or sputtering method in the prior art. Therefore the total content of hydrogen and halogen in the a-SiGe and a-Si layer is limited at most and is generally within the range of from 10 to 40 at.% (U.S. Pat. Nos. 4,265,991 and 4,490,450).

The maximum oscillating wavelength capable of stably giving a high output power with a semiconductor laser which is now practically used is from 780 to 830 nm. However, a Ge atom-free a-Si photosensitive member could not have a sufficient sensitivity to the light having a wavelength falling within the range. Therefore, if the member is to be used as a photosensitive member in a laser printer or the like device to be driven with a light source of a semiconductor laser, some pertinent changes must be imparted to the member.

On the other hand, as containing Ge, the a-SiGe layer may have a reduced optical band gap and can therefore have an improved sensitivity to lights having a long wavelength. However, since the total content of hydrogen and halogen in the layer is strictly limited to fall within the range of from 10 to 40 at.%, the layer is to have a small dark resistivity and have an extremely lowered charge-retention capacity. Additionally, the layer cannot have a sufficient light-sensitivity as a whole.

In order to overcome the problem of the lowered charging characteristic, which is one drawback of the photosensitive member having a photoconductive layer composed of only the a-SiGe layer, one means has been proposed in which an a-Si layer to have a function essentially as a charge-retention layer and a charge-transportation layer is employed and the a-Si layer is laminated below the a-SiGe layer (in the side near to the support) to thereby reduce the thickness of the a-SiGe layer to inhibit the decrease of the dark resistivity.

However, even in the photoconductive layer having such a laminate structure (composed of a-SiGe layer in the surface side of the photosensitive member and a-Si layer in the side near to the support), improvement of the charging characteristic is still insufficient. The reason would be as follows:

In the a-Si layer and a-SiGe layer, the carrier is essentially thermally excited rather than the band-to-band level, and after the excited carrier the band-to-band level is to have a charge with a polarity opposite to the excited carrier. In the case of positive charge, since the a-Si layer and a-SiGe layer to be employed as a photoconductive layer are made to be p-type ones in consideration of the running capacity of the carrier, a positive carrier with a polarity which is same as the positive charge is excited and the band-to-band level is to have the remaining negative charge. The phenomenon is same as that in which the negative charge as excited in the support to the positive surface charge is introduced into the position of the excited positive carrier. Therefore, where an a-SiGe layer which has a large amount of heat-excited carriers is provided near to the surface layer of a photosensitive element, the charge characteristic of the member would be noticeably deteriorated.

Moreover, as already mentioned above, both the a-Si layer and the a-SiGe layer have a total amount of hydrogen and halogen of being 40 at.% or less. Therefore, the photosensitive member is to have a small resistivity and have a poor charging characteristic.

In order to overcome the problem, it may be considered to reverse the order for lamination of the layers, or that is, the a-SiGe layer is provided to the side of the support and the a-Si layer to the surface side. However, in order to at least maintain the function as a photoconductive layer, the layer over the a-SiGe layer is necessary to have a good light-transmittance to the incident rays having a wavelength of from 680 to 730 nm. Despite of the necessity, the conventional a-Si layer has a total amount of hydrogen and halogen of being 40 at.% or less and therefore has a small optical band gap of being approximately 1.7 eV and, as a result, it does not satisfy the light-transmittance requirement. Accordingly, the indicent rays would be absorbed by the band-to-band level of the a-Si layer and therefore could not act as a carrier and to thereby cause lowering of the light-sensitivity of the photosensitive member as a whole.

On the other hand, in accordance with a conventional method of forming onto conductive layer, the deposition rate for the layer and the gas-utilizing efficiency are both low. In particular, where an expensive gas such as $GeH_4$ or $Ge_2H_6$ is used as a raw material gas in forming a-SiGe layer, the cost of the photosensitive member to be formed is extremely high. Moreover, if the deposition rate is to be increased in the conventional method, generation of a polymer powder which consists essentially of $(SiH_2)_n$ is inevitable. The polymer powder would adhere to the substrate of the photosensitive member during the deposition thereon to interfere with a normal growth of the film being formed. As a result, the photosensitive member obtained is to be a non-conforming product. From the point, the cost of the photosensitive member product to be formed by the conventional method is to be extremely high.

In conclusion, a photosensitive member having an a-SiGe layer as formed by the conventional plasma CVD method or sputtering method which has a limited content of hydrogen and halogen of being from 10 to 40 at.% or having a laminate layer composed of the a-SiGe layer and an a-Si layer also with a limited content of hydrogen and halogen of being from 10 to 40 at.%, as a photoconductive layer is far from practical use in view of the electrical characteristics and the cost thereof, irrespective of the order of lamination of the two layers.

It is known to use an a-Si layer or a-SiN layer as formed by electron cyclotron resonance method as a photoconductive layer of a photosensitive member for electrophotography (U.S. Pat. No. 4,532,199), but it is unknown to use an a-SiGe layer formed by the same method.

SUMMARY OF THE INVENTION

In accordance with the present invention, there is provided a photosensitive member for electrophotography comprising a photoconductive layer formed on an electroconductive support, in which the photoconductive layer is composed of an amorphous silicon germanium layer formed by electron cyclotron resonance (ECR) method and containing hydrogen and/or halogen in an amount of more than 40 at.% to 65 at.% and an amorphous silicon nitride layer formed by ECR method and containing hydrogen and/or halogen in an amount of more than 40 at.% to 60 at.%, the amorphous silicon nitride layer being laminated on the amorphous silicon germanium layer.

In the photosensitive member for electrophotography of the present invention, the above-mentioned a-SiGe layer acts as a charge-generation layer and the above-mentioned a-SiN layer as a charge-retention and charge-transportation layer, whereby the sensitivity of the member to laser rays falling within a long wavelength range as well as the charge-retention capacity of the member is improved.

DETAILED DESCRIPTION OF THE PREFERRED EMBODIMENTS

Figure 1:
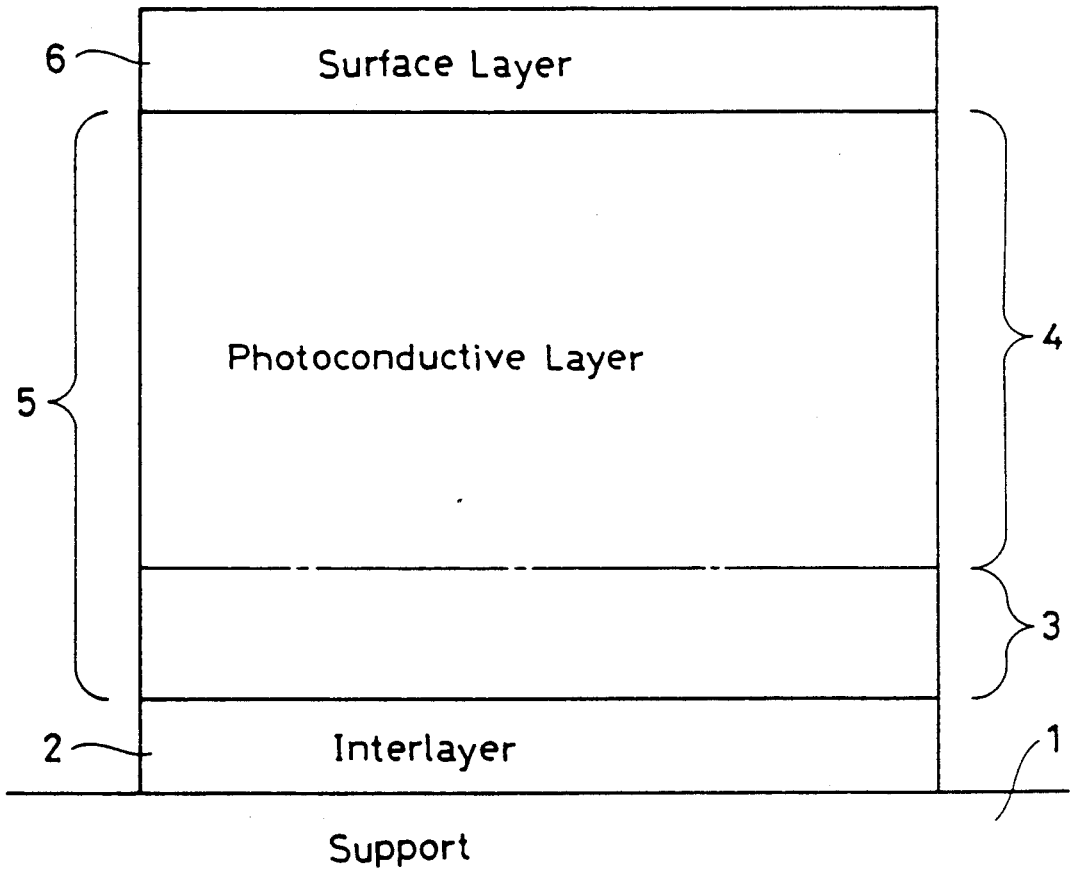
FIG. 1 is an enlarged sectional view of a part of one example of a photosensitive member for electrophotography of the present invention.

As the electroconductive support for use in the present invention, anyone which is generally employed in this technical field can be employed. For instance, there are mentioned plates made of metals such as Al, Cr, Mo, Au, Ir, Nb, Ta, Pt, Pd or the like or of alloys thereof. Additionally, there are further mentioned films or sheets made of synthetic resins such as polyester, polyethylene, cellulose acetate, polypropylene or the like or sheets made of glass or ceramics, the surfaces of the films or sheets being treated to be electroconductive. The shape of the support is not specifically limited but may be selected in accordance with the intended object.

The photoconductive layer in the member of the present invention is composed the above-mentioned specific amorphous silicon germanium (a-SiGe) layer and specific amorphous silicon nitride (a-SiN) layer, and the a-SiGe layer is positioned near to the electroconductive support. The a-SiGe layer is composed of a-SiGe which has a total amount of hydrogen and halogen of being from more than 40 at.% to 65 at.%. Preferably, the amount is 55 at.% or less in view of the sensitivity of the member to lights having a long wavelength range. In the layer, the Ge-content is suitably from 5.3 to 150 at.%, preferably from 18 to 82 at.%, more preferably from 43 to 67 at.%. The Ge-content may be uniform along the direction of the thickness of the a-SiGe layer but preferably has a so inclined concentration distribution that the Ge-content is larger toward the side of the support in view of the electric and structural conformity to the adjacent a-SiN layer.

On the other hand, the a-SiN layer is composed of a-SiN which has a total amount of hydrogen and halogen of being from more than 40 at.% to 60 at.%. Preferably, the amount is 55 at.% or less in view of the electric and structural conformity to the adjacent a-SiGe layer. The N-content in the layer is suitably from 0.1 to 40 at.% in view of the function as a charge transportation layer.

The a-SiGe layer and a-SiN layer each having such a high total content of hydrogen and halogen can be formed by ECR method, and the details thereof are illustrated in the example to follow hereunder. Preferably, ECR method is conducted for forming the layers under the conditions of a microwave power of from 10 W to 10 KW, preferably from 100 W to 5 KW, more preferably from 1 KW to 5 KW and a gas pressure for plasma-exciting of being from $10^{-5}$ to $10^{-1}$ Torr, preferably from $5\times10^{-4}$ to $1\times10^{-2}$ Torr, more preferably from $5\times10^{-4}$ to $5\times10^{-3}$ Torr.

In the photosensitive member for electrophotography of the present invention, a pertinent interlayer (for example, B- or P-doped a-Si, a-SiC, a-SiN or a-SiO) may be between the electroconductive support and the photoconductive laminate layer, and the surface of the photoconductive laminate layer may be covered with a pertinent surface-protecting layer (for example, a-SiC, a-SiN, a-SiO).

In the photosensitive member of the present invention, the a-SiN layer has a larger dark resistivity than the a-SiGe layer, and when the surface of the photosensitive member is charged by means of a charging device, the surface of the photosensitive member may well keep the charges thereon because of the present of the a-SiN layer. Where laser rays are irradiated to the member, carriers are excited in the a-SiGe layer and they move through the a-SiN layer to cancel the charges on the surfaces of the member. Accordingly, in the photosensitive member of the present invention, the a-SiGe layer functions as a charge generation layer and the a-SiN layer as a charge retention layer and a charge transportation layer. The SiGe layer having a total content of hydrogen and/or halogen of being more than 40 at.% has a sufficient light-sensitivity to rays having a long wavelength (in a range of from 780 to 830 nm). The other a-SiN layer also having a total content of hydrogen and/or halogen of more than 40 at.% has an extremely high resistivity of $10^{13}$ Ωcm or so and has a sufficient photosensitivity, although it is not doped with boron. As is noted from the facts, the a-SiN layer further has a sufficient capacity of transporting excited charges in an electric field. Moreover, the layer has a sufficiently large optical band gap to rays having a wavelength of from 780 to 830 nm and is therefore transparent. The order of lamination of the layers is such that the a-SiN layer is laminated on the a-SiGe layer. As a result, the photosensitive member of the present invention has a sufficient sensitivity even to rays having a long wavelength and has an excellent charge retention capacity. The present invention therefore provides an excellent photosensitive member for electrographic laser printer.

In accordance with the present invention, since the respective layers for constituting the photosensitive layer may be formed by ECR method, the yield of products as well as the deposition rate may be increased and the manufacture cost may therefore be lowered.

The thickness of the a-SiGe layer is generally suitably from 0.1 to 10 microns, and that of the a-SiN layer is from 1 to 50 microns in the constitution of the present invention.

FIG. 1 is an enlarged sectional view to show the constitution of one example of a photosensitive member of the present invention.

Referring to FIG. 1, (1) is an electroconductive support made of, for example, Al, and an interlayer (2) for inhibiting introduction of charges from the side of the support, a photo-conductive layer (5) composed of an a-SiGe layer (3) and an a-SiN layer (4) as laminated in order, and a surface coat layer (6) are laminated on the support (1) in order. Among the layers, the interlayer (2) and the surface coat layer (6) may optionally be omitted.

Figure 2:
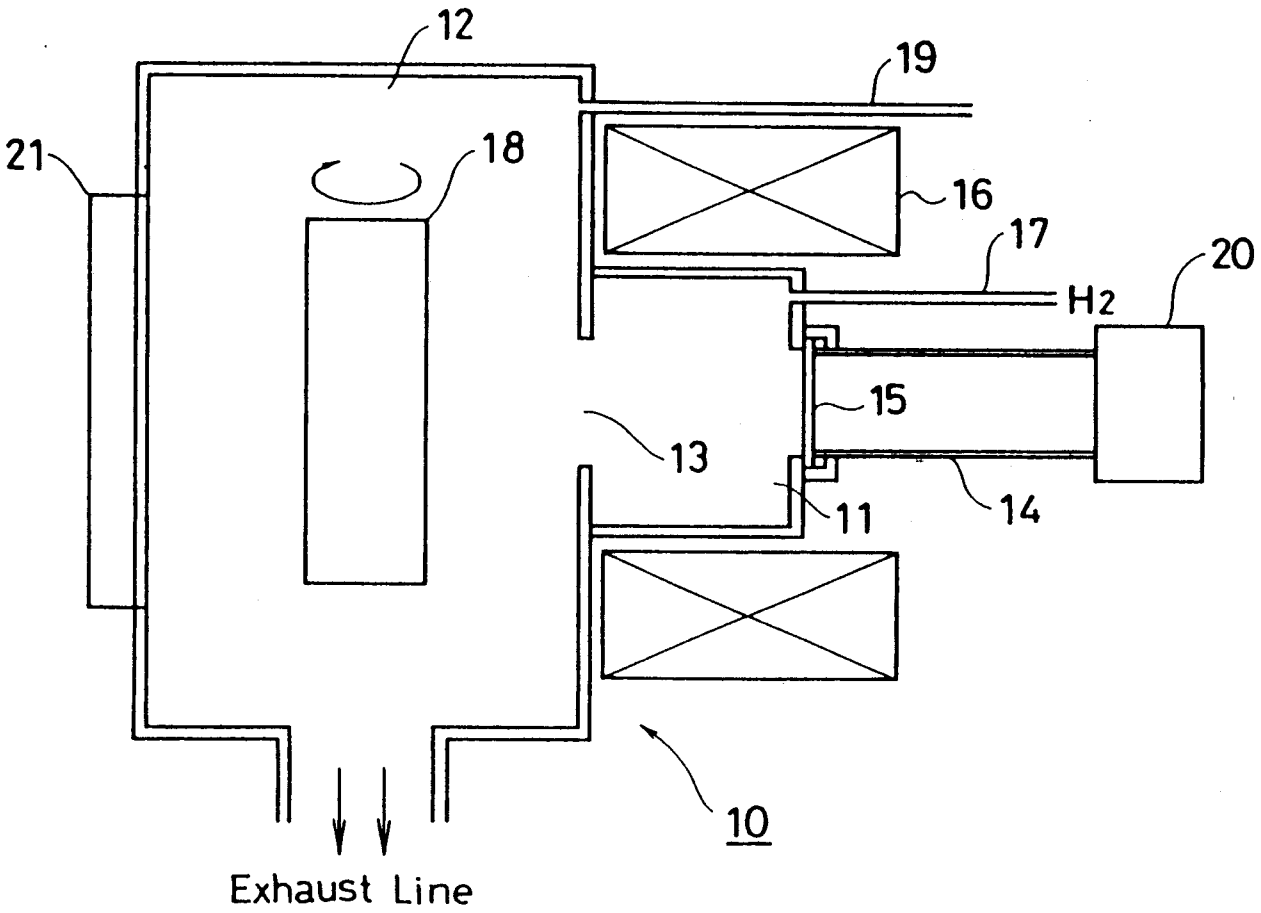
FIG. 2 is a view to show the constitution of the film-forming apparatus which is employed in forming the photosensitive member for electrophotography of the present invention.

FIG. 2 is a view to show an apparatus for ECR method for forming the above-mentioned photosensitive member for electrophotography.

In the apparatus (1) of FIG. 2, the plasma chamber (11) is to have a cavity resonator constitution where a microwave of 2.45 GHz as generated from a microwave power source (20) is introduced thereinto through a wave guide (14). The microwaveintroducing window (15) is composed of a quartz glass which may pass the microwave therethrough. $H_2$ is introduced into the plasma chamber (11) through a duct (17) at any desired time. A magnetic coil (16) is provided around the plasma chamber (11), and it excites the plasma in the chamber (11) by ECR resonance with the microwave therein. Additionally, a diffusion magnetic field is imparted to the chamber by the coil (16) so as to take out the plasma as generated therefrom. (12) shows a deposition chamber, and an electroconductive support (18) made of Al is set therein. The drum-like electroconductive support (18) is held by a stand (not shown) and is rotated.

To the deposition chamber (12) is introduced, as a raw material gas, a mixture comprising a silicon compound containing hydrogen and/or halogen, such as $SiH_4$, $Si_2H_6$, $SiF_4$, $SiC_4$, $SiHCl_3$ or $SiH_2Cl_2$, and a germanium compound containing hydrogen and/or halogen, such as $GeH_4$, $GeF_4$, $GeCl_4$, $GeF_2$ or $GeCl_2$. First, the plasma chamber (11) and the deposition chamber (12) are exhausted and a raw material gas is introduced thereinto via a duct (19), whereupon the gas pressure is set to fall within the range of from $10^{-3}$ Torr to $10^{-4}$ Torr. Along with the introduction, microwaves are introduced in to the plasma chamber (11) and a magnetic field is imparted thereto so as to excite the plasma therein. The plasmatic raw material gas is then introduced onto the electroconductive support (18) by the diffusion magnetic field to deposit a-SiGe thereon. During the deposition, since the electroconductive support (18) is rotated, a uniform film is formed around the complete surface of the support (18). Additionally, by adjusting the position or size of the plasma take-out window (13), the uniformity of the film to be formed may further be improved.

Figure 3:
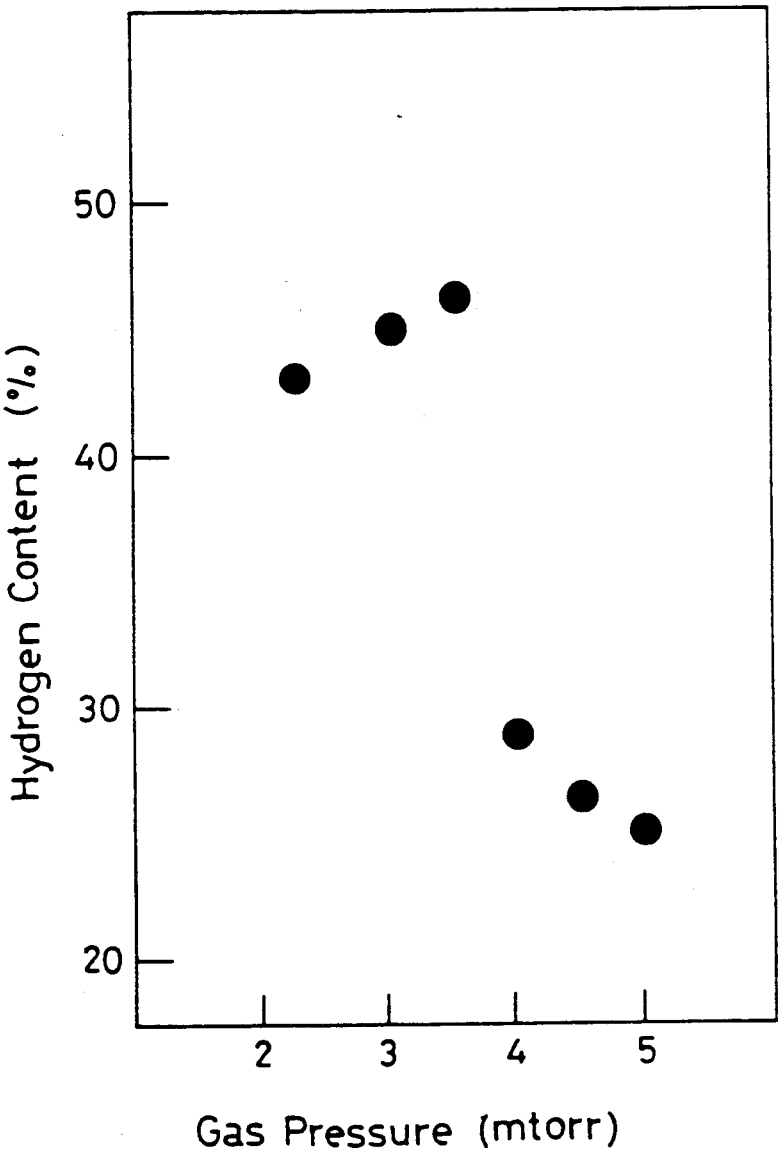
FIG. 3 to FIG. 5 are views each showing the gas pressure-dependence of the hydrogen content, photoconductivity and dark resistivity of the a-SiGe layer of the photosensitive member for electrophotography of the present invention, respectively.
Figure 4:
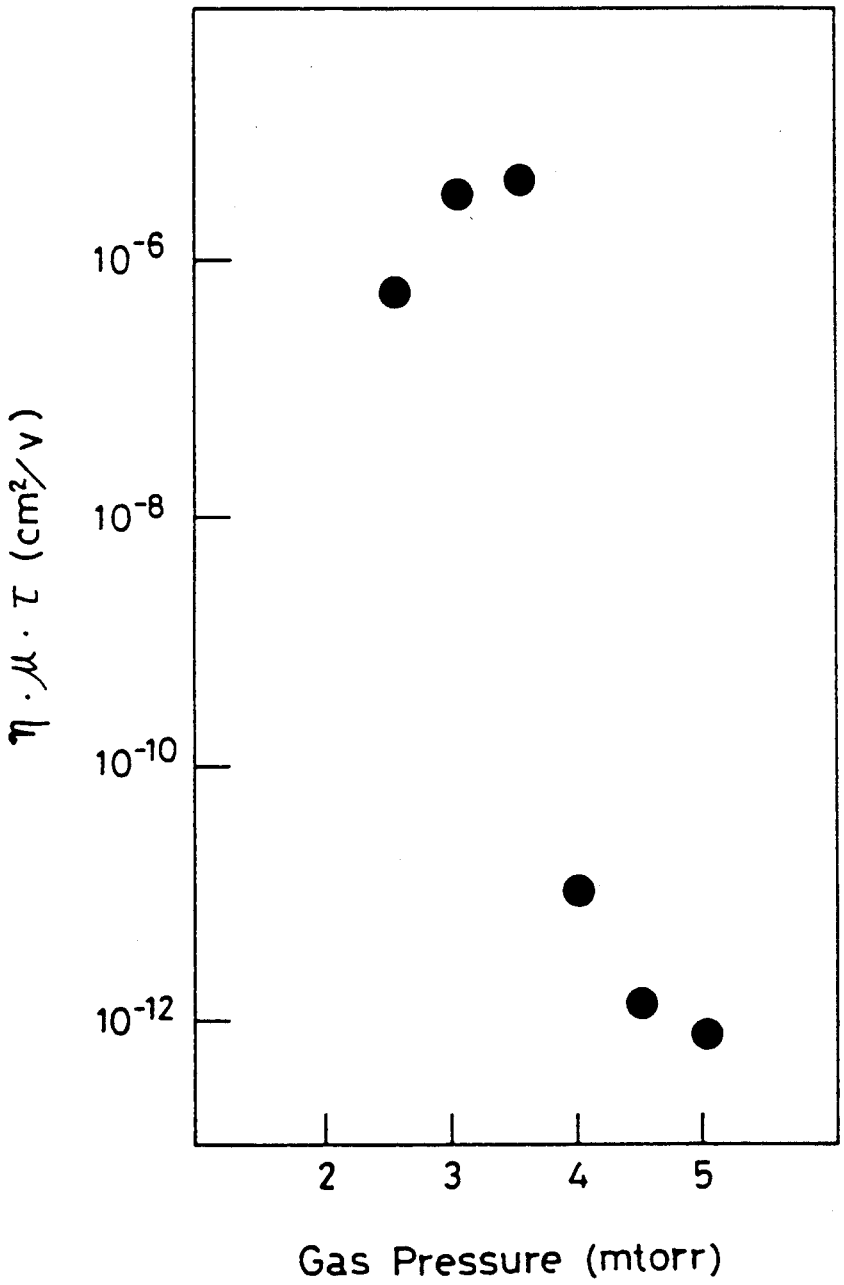
Figure 5:
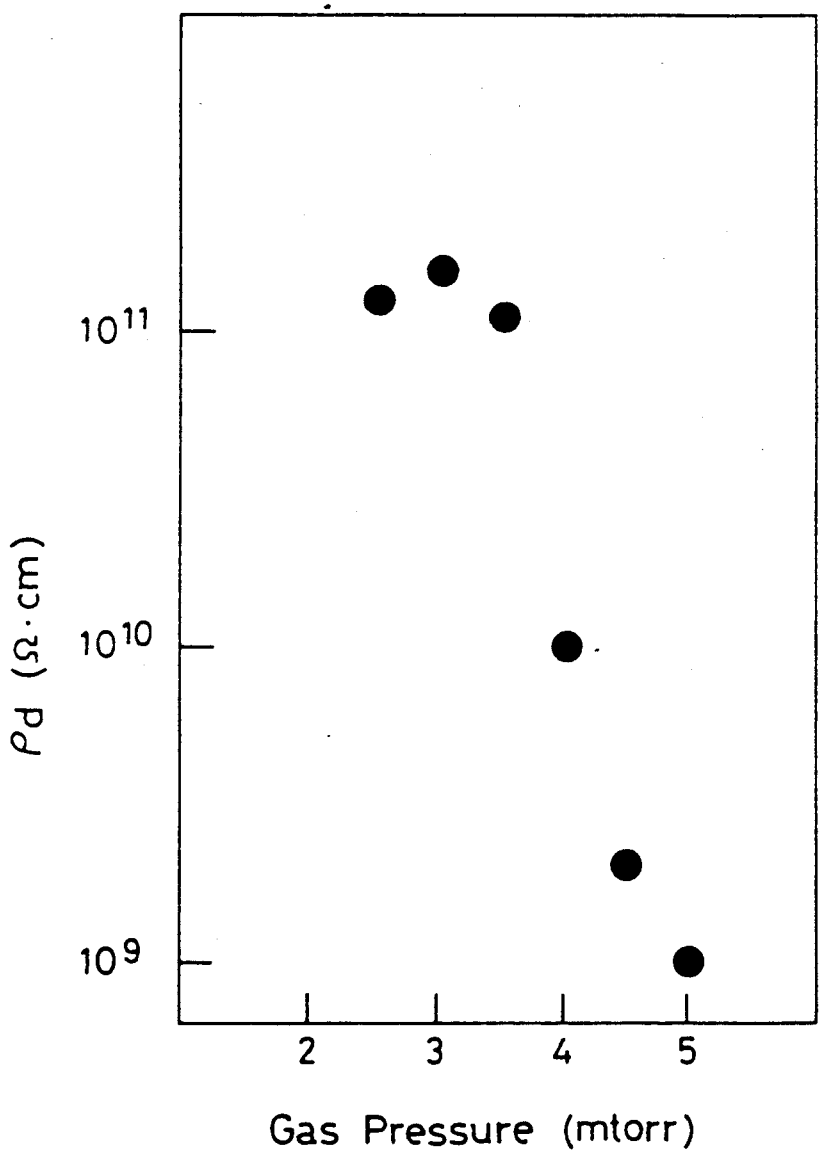

One embodiment of forming a-SiGe layer by the use of the apparatus (10) having the above-mentioned constitution will be explained below. For forming a-SiGe layer, a mixed gas comprising $SiH_4$ gas and $GeH_4$ gas is used as a raw material gas and the gas pressure is varied in this experiment. Regarding the filming condition, the raw material gas weight is $(SiH_4+GeH_4)=120$ sccm with the proviso that $SiH_4/(SiH_4+GeH_4)=0.81$, the microwave power is 2.5 KW, and the support is not heated. The gas pressure-dependence of the hydrogen content in the a-SiGe film formed, that of the light conductivity ($\eta\mu\tau$) using a 830 nm semiconductor laser, and that of the dark resistivity ($\rho d$) are shown in FIG. 3 to FIG. 5, respectively. In all the films formed, the Ge content was within the range of from 45 to 61 at.%.

As is obvious from FIG. 3 to FIG. 5, a-SiGe layers having a dark resistivity of more than $10^{11}$ Ωcm and having a high photo-conductivity (or having a high photo-sensitivity) could be formed only when the hydrogen content is more than 40 at.%. Such a-SiGe layers having a dark resistivity of more than $10^{11}$ Ωcm and having a high photo-conductivity are superior to any other conventional a-SiGe layers having a hydrogen content of 40 at.% or less, the latter could not display such values. However, if the hydrogen content in the layer was more than 65 at.%, the optical band gap again increased, the effect attainable by the addition of Ge was neglected and the sensitivity to lights having a long wavelength deteriorated. Accordingly, the hydrogen content in the layer is to be generally from more than 40 at.% to 65 at.%, most preferably from more than 40 at.% to 55 at.%.

Next, where the ratio of the mixed raw material gas was varied within the range of the hydrogen concentration of being from 43 to 48 at.% and the germanium concentration was also varied, it was found that the effect of decreasing the optical band gap could not almost be attained and the sensitivity to lights having a long wavelength could not be improved when the germanium concentration was less than 5.3 at.% to Si atoms. On the other hand, when the germanium concentration was more than 150 at.% to Si atoms, the dark resistivity was too small although the optical band gap decreased, and therefore the film could no more be used as a charge generation layer in the present invention. Accordingly, the germanium concentration is to be generally from 5.3 to 150 at.%, preferably from 18 to 82 at.%, most preferably from 43 to 67 at.%, to Si atoms.

Where the deposition was effected under the condition of the gas pressure (from 2.5 to 3.5 m torr) of forming films having a dark resistivity of more than $10^{11}$ Ωcm and a high photoconductivity, the deposition rate was high as compared with the condition of other gas pressure and was almost 5 to 6 times higher than the conventional method. From the fact, it is obvious that the films formed under the condition of a high deposition rate in accordance with the present invention may have improved electric characteristics, and therefore the present invention has a merit in this respect which could not be attained by the conventional method. Moreover, in accordance with the process of the present invention, no polymer powder consisting essentially of $(SiH_2)_n$ formed and therefore the process was free from any filming disorder.

Needless to say, when a halogen-containing silicon compound or germanium compound is used as the raw material gas in the process of the present invention, the total amount of hydrogen and halogen is to be more than 40 at.% to 65 at.%, most preferably from more than 40 at.% to 55 at.%.

Next, another embodiment of forming a-SiN layer by ECR method of using the above-mentioned filming device (10) will be mentioned below. For forming a-SiN layer, a silicon compound containing hydrogen and/or halogen, such as $SiH_4$, $Si_2H_6$, $SiF_4$, $SiCl_4$, $SiHCl_3$ or $SiH_2Cl_2$, or a mixed gas comprising two or more of them is introduced into the deposition chamber (12) as a raw material gas. As a gas of supplying nitrogen, a gas of $NH_3$ or $N_2$ is most suitable. First, the plasma chamber (11) and the deposition chamber (12) are exhausted and a raw material gas is introduced thereinto, whereupon the gas pressure is set to fall within the range of from $10^{-3}$ Torr to $10^{-4}$ Torr. Along with the introduction, microwaves are introduced into the plasma chamber (11) and a magnetic field is imparted thereto so as to excite the plasma therein. The plasmatic raw material gas is then introduced onto the support by the diffusion magnetic field to deposite a-SiN thereon. During the deposition, the raw material gas weight is $(SiH_4+NH_3)=120$ sccm, the gas pressure is $SiH_4/(SiH_4+NH_3)=0.81$, the microwave power is 2.5 KW, and the support is not heated.

Figure 6:
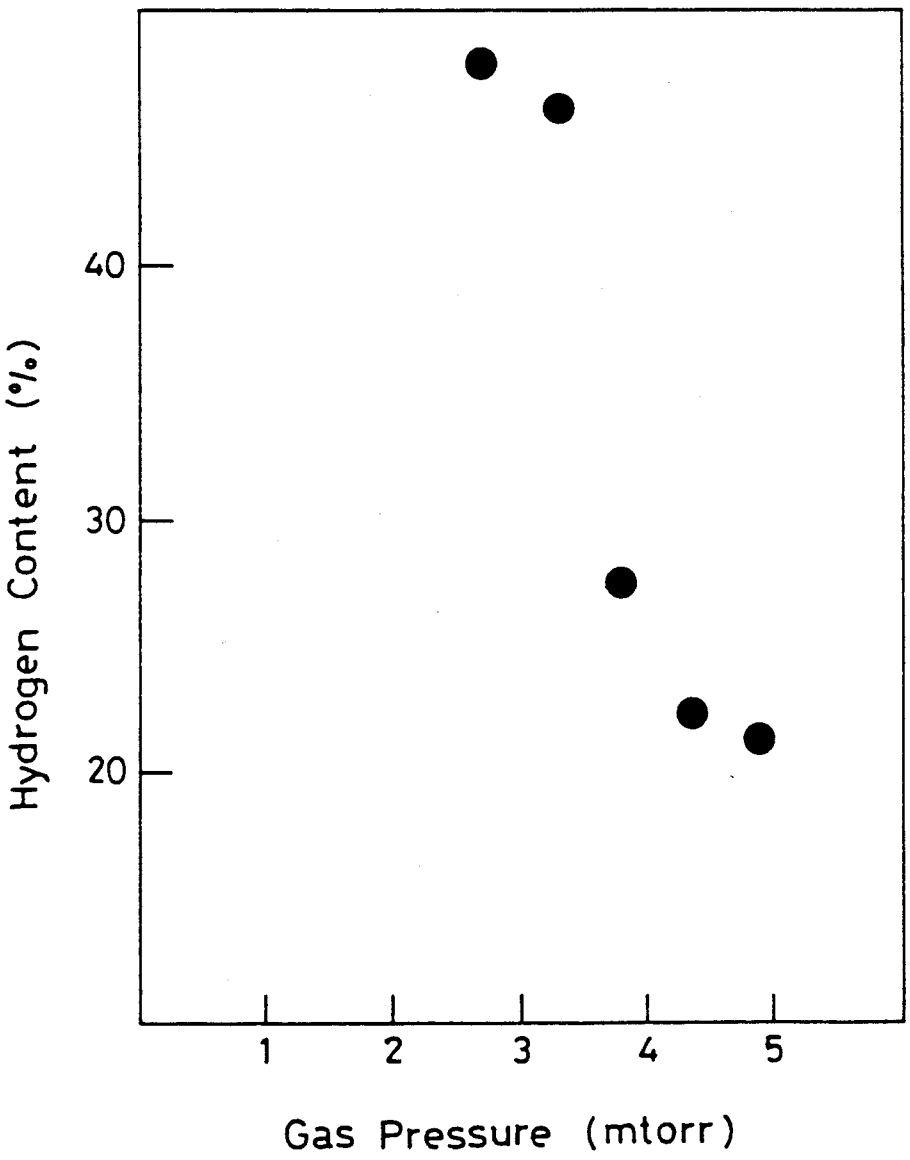
FIG. 6 to FIG. 8 are views each showing the gas pressure-dependence of the hydrogen content, photoconductivity and dark resistivity of the a-SiN layer of the photosensitive member for electrophotography of the present invention, respectively.
Figure 7:
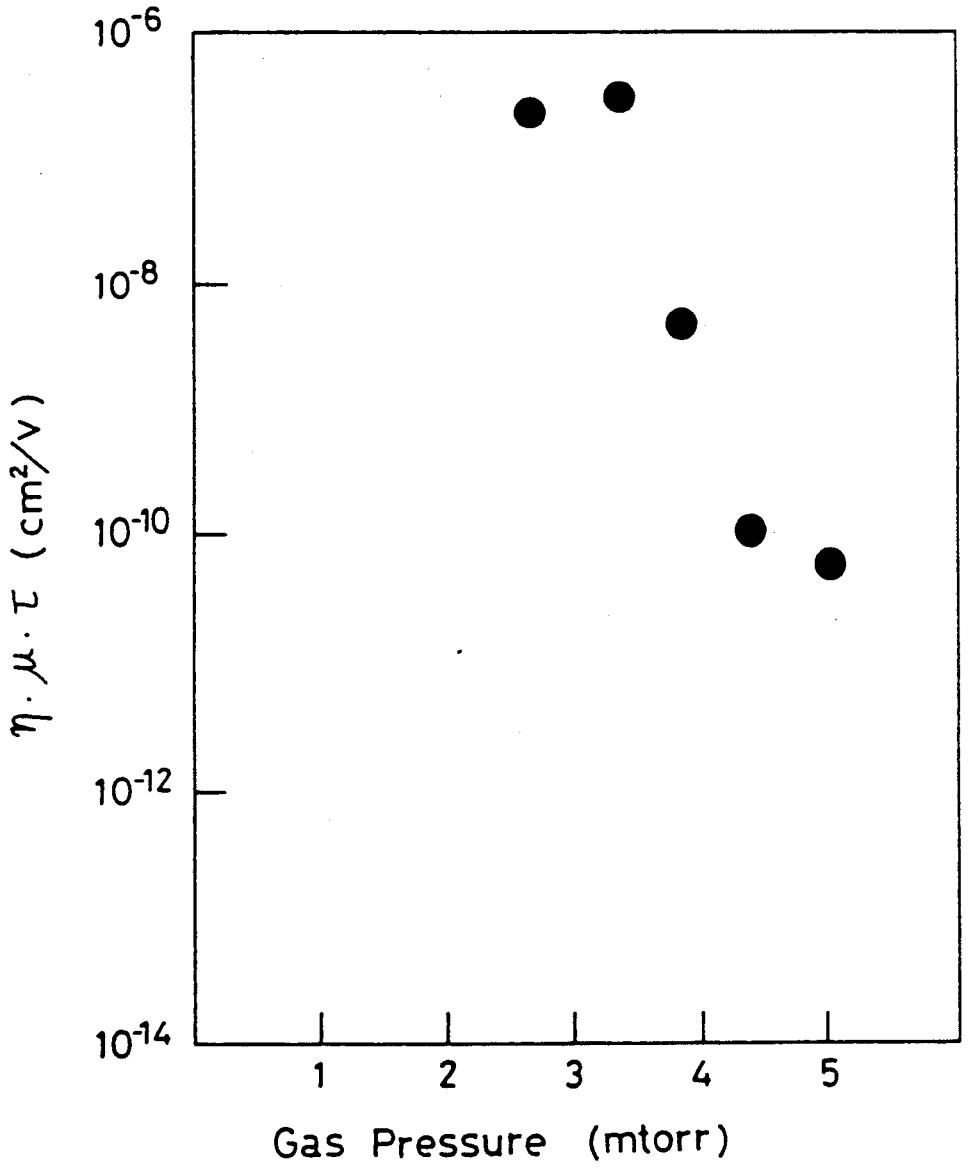
Figure 8:
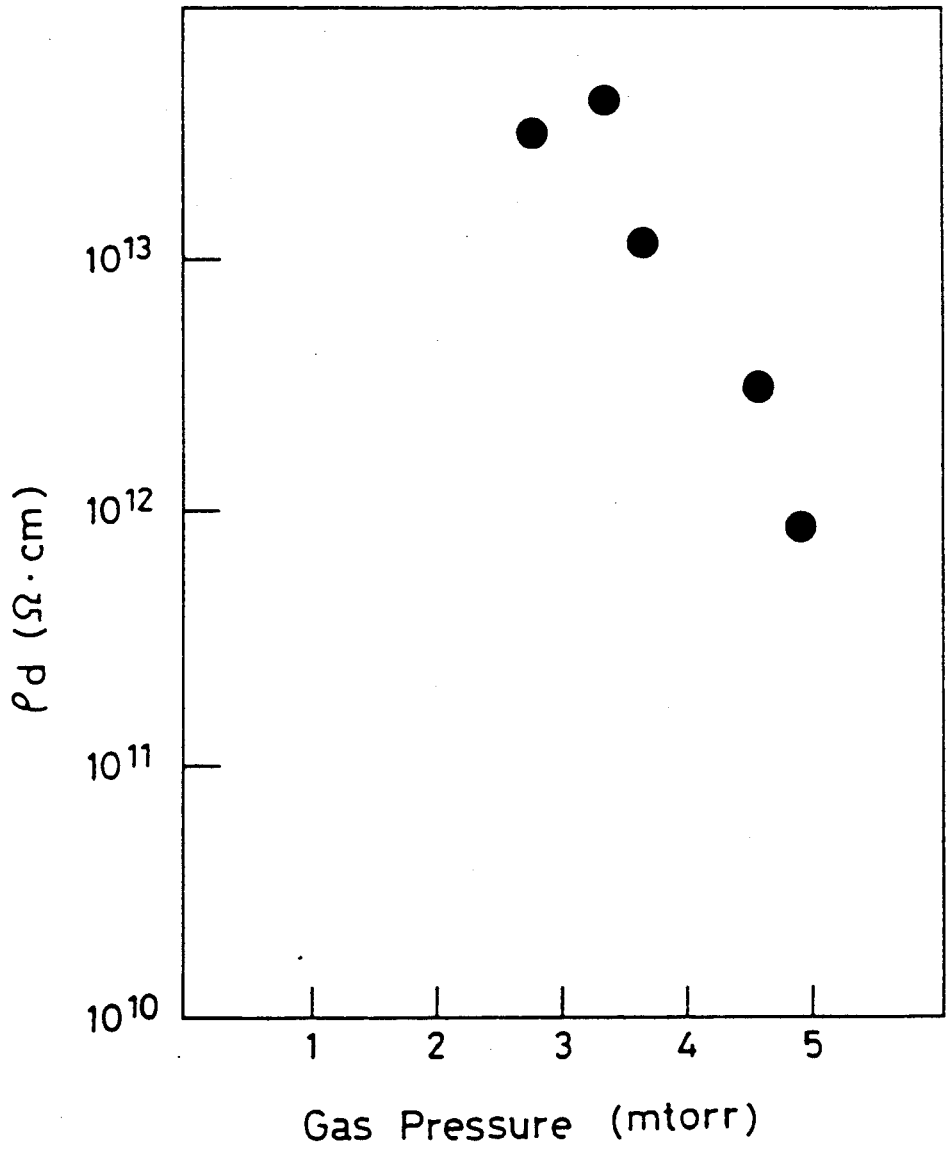
Figure 9A:
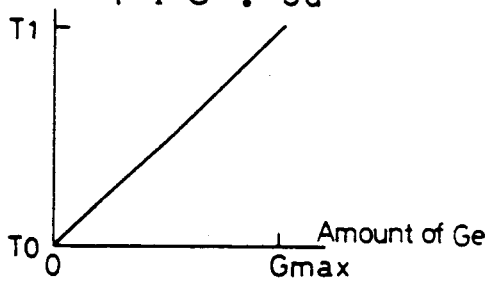
FIGS. 9*a*–9*h* gives graphs each explaining the distribution of the Ge concentration in the a-SiGe layer in the photosensitive member for electrophotography of the present invention.
Figure 9B:
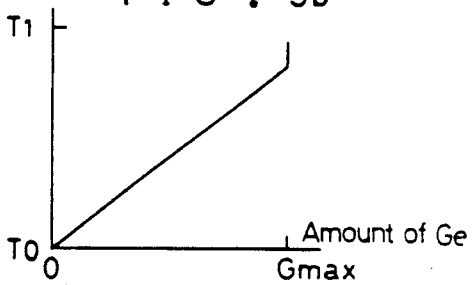
Figure 9C:
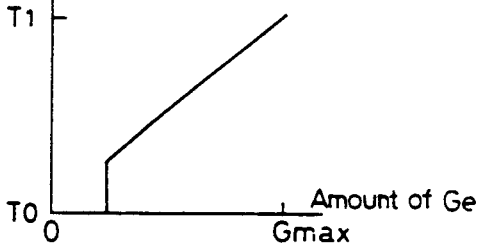
Figure 9D:
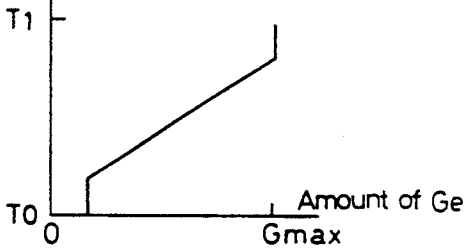
Figure 9E:
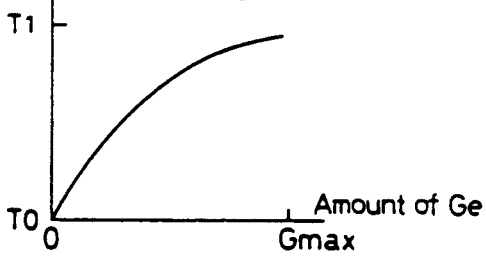
Figure 9F:
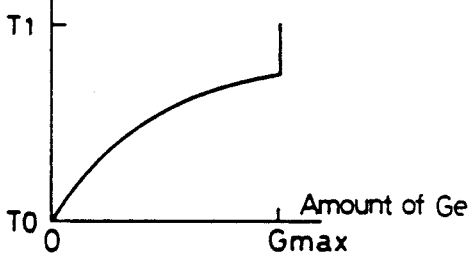
Figure 9G:
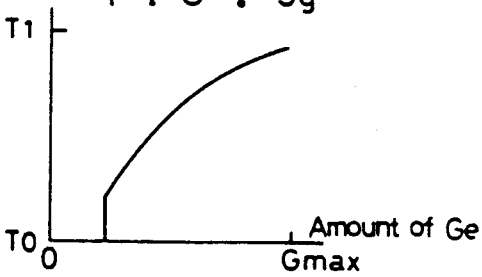
Figure 9H:
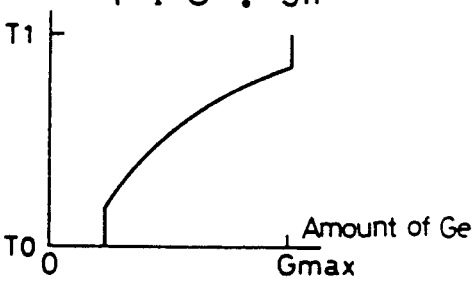

The gas pressure-dependence of the hydrogen content in the a-SiN layer formed, that of the light conductivity ($\eta\mu\tau$) using a 565 nm semiconductor laser, and that of the dark resistivity ($\rho d$) are shown in FIG. 6 to FIG. 8, respectively. As is obvious therefrom, a-SiN layers having a dark resistivity of more than $10^{13}$ Ωcm and a high photo-conductivity (or having a high photosensitivity) were formed, though not doped with boron, by properly selecting the gas pressure and adjusting the hydrogen content to be more than 40 at.%. Additionally, it is also noted from FIG. 5 that the dark resistivity which is inversely proportional to $\mu$ is higher in the range of a high photo-conductivity. From the fact, it may be presumed that value $\tau$ would be large in the said range. As is known, since the value $\tau$ has a strong causality to the dangling bond (unsaturated bond) of atoms, it may be considered that the unsaturated bond of Si atoms could essentially be reduced by making the hydrogen content in the layer to be more than 40 at.%.

As mentioned above, a-SiN layers having a dark resistivity of more than $10^{13}$ Ω cm and a high photo-conductivity can be formed by the present invention though they are not doped with boron. However, a-SiN layers having a hydrogen content of 40 at.% or less as formed by the conventional method could not display such favorable characteristics. Moreover, during the process of forming the above-mentioned a-SiN layers in accordance with the present invention, no polymer powder consisting essentially of $(SiH_2)_n$ formed and therefore the process was free from any filming disorder. Further, the deposition rate and the gas utilization efficiency largely depend upon the gas pressure. By properly selecting the gas pressure, therefore, the deposition rate and the gas utilization efficiency in the process of the present invention could be increased 6 to 10 times higher than the conventional process. In particular, both the deposition rate and the gas utilization efficiency were found high, when the gas pressure was such that may form a-SiN layer having a hydrogen content of more than 40 at.%, or such that may form a-SiN layer having a dark resistivity of more than $10^{13}$ Ωcm and a high photo-conductivity (from 2 to 3.5 mtorr). As opposed to the results, in accordance with the conventional method, the photo-sensitivity of the a-SiN layer to be formed often worsens when the deposition rate is higher. It is understood that the present invention is superior to the conventional method in this respect.

Needless to say, when a halogen-containing silicon compound is introduced as a raw material gas in the above-mentioned process, the total amount of hydrogen and halogen is to be more than 40 at.%. Where the total content of hydrogen and halogen in the a-SiN layer is more than 60 at.%, there would be electrical and mechanical inconformity between the a-SiN layer and the a-SiGe layer to be adjacent thereto, whereby the residual potential would increase. Accordingly, the total amount of hydrogen and halogen in the a-SiN layer is suitably from more than 40 at.% to 60 at.%, most preferably from more than 40 at.% to 55 at.%.

Next, the proportion of $SiH_4$ and $NH_2$ in the mixed gas to be introduced was varied with fixing the hydrogen content to fall within the range of from 43 to 46 at.%, so as to vary the nitrogen concentration in the layer formed. As a result, no effect of improving the optical hand gap could not be attained when the nitrogen concentration was less than 0.1 at.%, and therefore the layer could not be transparent to semiconductor lasers as a light source. In accordance with the present invention, the photosensitive member has a structure that the charge generation layer (a-SiGe layer) is under the charge transportation layer (a-SiN layer), as shown in FIG. 1. Therefore, as mentioned above, if the a-SiN layer is opaque to semiconductor lasers, the layer is inappropriate as the charge transportation layer of the photoconductive member for electrophotography of the embodiment. On the other hand, if the nitrogen concentration in the layer is more than 40 at.%, the running property of the excited carriers rapidly lowers. Therefore, the layer having such a larger nitrogen concentration is also inappropriate as the charge transportation layer. On these grounds, the nitrogen concentration in the layer is to be from 0.1 to 40 at.% to Si atoms.

Next, some examples of the photosensitive member for electrophotography of the present invention where the photoconductive laminate layer is composed of a-SiGe having a total content of hydrogen and/or halogen of more than 40 at.% and a-SiN having a total content of hydrogen and/or halogen of more than 40 at.% are illustrated below.

EXAMPLE 1

A photoconductive layer was constructed, which was composed of an a-SiGe layer having a germanium atom content (as Ge/Si) of 61 at.%, a hydrogen content of 46 at.% and a film thickness of 5 microns, the layer being doped with a small content of boron, and an a-SiN layer having a nitrogen atom content (as N/Si) of 13at.%, a hydrogen content of 48 at.% and a film thickness of 25 microns, the layer being also doped with a small amount of boron, where the latter a-SiN layer was laminated on the former a-SiGe layer. The a-SiGe layer and a-SiN layers were both formed by ECR method. The photoconductive layer was covered with a surface coat layer of an a-SiC film, which was formed by ECR method, and it was formed into a photosensitive member for positive charging. The member additionally had an interlayer of an a-Si film, which was formed by the same ECR method and was doped with a large amount of boron. The conditions for forming the respective layers are shown in Table 1 below.

TABLE 1

| | Inter-layer | a-SiN Layer | a-SiGe Layer | Surface Coat Layer |
|---|---|---|---|---|
| μ wave power (KW) | 2.5 | 2.5 | 2.5 | 2.5 |
| $SiH_4$ flow amount (sccm) | 120 | 97 | 97 | 30 |
| $B_2H_6$ flow amount (sccm) | 20 | 10 | 12.5 | — |
| $GeH_4$ flow amount (sccm) | — | — | 23 | — |
| $CH_4$ flow amount (sccm) | — | — | — | 1000 |
| $NH_3$ flow amount (sccm) | — | 23 | — | — |
| gas pressure (mtorr) | 2.8 | 2.8 | 2.8 | 3.0 |

$B_2H_6$ as employed in formation of the interlayer and a-SiN layer was one as diluted in $H_2$ in a concentration of 3000 ppm. $B_2H_6$ as employed in formation of the a-SiGe layer was one as diluted in $H_2$ in a concentration of 30 ppm. The thickness of the interlayer and that of the surface coat layer were 2.5 microns and 0.3 micron, respectively.

As the gas for boron-doping, a compound composed of boron and hydrogen or halogen, such as $B_2H_6$, $BCl_3$ or $BH_3$, is desired. As an atom having the same function as boron, for example, Al, Ga or In is suitable.

In forming the photosensitive member, no polymer powder consisting essentially of $(SiH_2)_n$ formed, and the deposition rate and the gas utilization efficiency were 6 to 10 times higher than those in the conventional method. Additionally, the charging characteristics of the photosensitive member formed were measured to be excellent. The photosensitive member was set in a commercial laser printer and used for image formation. As a result, good images were formed. Where an a-SiN film or a-SiO film as formed by ECR was used as the surface coat layer in forming the same member as above, the same good results were obtained.

EXAMPLE 2

The same process as in Example 1 was repeated, except that the gas pressure in filming the a-SiGe layer and a-SiN layer was varied as indicated in Table 2 below. The results are shown in the same Table 2.

TABLE 2

| | | Gas Pressure (mtorr) in Forming a-SiGe Layer | | | | | |
|---|---|---|---|---|---|---|---|
| | | 2.4 | 2.8 | 3.3 | 3.8 | 4.3 | 4.8 |
| Gas Pressure (mtorr) in Forming a-SiN Layer | 2.6 | ◎ | ◎ | ◎ | ○ | ○ | Δ |
| | | ◎ | ◎ | ◎ | X | X | X |
| | 3.2 | ◎ | ◎ | ◎ | ○ | ○ | Δ |
| | | ◎ | ◎ | ◎ | X | X | X |
| | 3.7 | ○ | ○ | ○ | Δ | X | X |
| | | Δ | Δ | Δ | X | X | X |
| | 4.4 | X | X | X | X | X | X |
| | | X | X | X | X | X | X |
| | 4.8 | X | X | X | X | X | X |
| | | X | X | X | X | X | X |

Notes:
Upper cell indicates charging characteristic and lower cell image-forming characteristic. The mark "◎" means the best, the mark "○" means good, the mark "Δ" means worse and the mark "X" means the worst.

As is obvious from Table 2 above, good results were obtained when the gas pressure was so properly selected that the hydrogen content in both the a-SiGe layer and a-SiN layer was more than 40 at.%. The charging characteristic was evaluated by measuring the surface potential and the charge retentivity by the use of a photosensitive member testing device. The germanium atom content (as Ge/Si) in the a-SiGe layer was within the range of from 45 to 64 % in every case. The thickness of each layer was same as that in Example 1.

EXAMPLE 3

The same process as in Example 1 was also repeated, except that phosphorus was doped to the photoconductive layer and the interlayer in place of boron. As a result, images of good quality were also obtained. The filming conditions are shown in Table 3 below.

TABLE 3

| | Inter-layer | a-SiN Layer | a-SiGe Layer | Surface Coat Layer |
|---|---|---|---|---|
| μ wave power (KW) | 2.5 | 2.5 | 2.5 | 2.5 |
| $SiH_4$ flow amount (sccm) | 120 | 97 | 97 | 30 |
| $PH_3$ flow amount (sccm) | 10 | 1 | 0.75 | — |
| $GeH_4$ flow amount (sccm) | — | — | 23 | — |
| $CH_4$ flow amount (sccm) | — | — | — | 1000 |
| $NH_3$ flow amount (sccm) | — | 23 | — | — |
| gas pressure (mtorr) | 2.8 | 2.8 | 2.8 | 3.0 |

$PH_3$ as employed in formation of the interlayer and a-SiN layer was one as diluted in $H_2$ in a concentration of 3000 ppm. $PH_3$ as employed in formation of the a-SiGe layer was one as diluted in $H_2$ in a concentration of 30 ppm. The thickness of the interlayer and that of the surface coat layer were 2.5 microns and 0.3 micron, respectively.

As the gas for phosphorus-doping, a compound composed of phosphorus and hydrogen or halogen, such as $PH_3$, $PCl_3$, or $PCl_5$, is suitable. As an atom having the same function as phosphorus, for example, N, Sb or O is suitable.

EXAMPLE 4

The same process as in Example 1 was repeated, except that the $GeH_4$ gas flow amount in forming the a-SiGe layer of the photoconductive layer was so varied that the germanium content in the layer was made larger in the direction nearer to the support. The characteristics of the photosensitive members thus formed were measured. AS a result, it was found that the charging characteristic was of course good and especially the residual potential was favorably small. Where the photosensitive member was set in a commercial layer printer and used for image formation, images of good quality were obtained. .Needless to say, the Ge-containing layers in these photosensitive members contained hydrogen in an amount of more than 40 at.% throughout the whole layers. There are various Ge-atom distributions as shown in FIGS. 9a–9h. It was confirmed that all of the illustrated cases were effective for lowering the potential. The matter which is common to all the cases is that the germanium atom distribution is continuous and that the germanium atom concentration is higher in the side nearer to the support. Where the a-SiN layer having a hydrogen content of more than 40 at.% and the a-SiGe layer having a reduced optical band gap are laminated as in the above-mentioned examples, the germanium atom distribution in the latter layer was found extremely effective for reducing the electrical and mechanical inconformity between the a-SiN layer and the a-SiGe layer.

As mentioned above in detail, in the present invention, the a-SiGe layer containing a specified amount of hydrogen and/or halogen has a sufficient photo-sensitivity even to lights having a long wavelength, and the a-SiN layer containing a specified amount of hydrogen and/or halogen shows an extremely high resistivity. Further, the latter a-SiN layer has an excellent capacity of transporting the light carrier as generated in the a-SiGe layer and introduced into the a-SiN layer to the surface layer in the presence of an electric field and additionally has a sufficiently large optical band gap. Accordingly, the a-SiGe layer acts as an excellent charge generation layer and the a-SiN layer as an excellent charge transportation layer. As a result, the photosensitive member of the present invention having a photoconductive layer composed of the said a-SiN layer and a-SiGe layer is to have a sufficient sensitivity even to lights having a long wavelength and an excellent charge retention capacity. Therefore, the photosensitive member for electrophotography of the present invention can be advantageously used in laser printers.

Since the a-SiGe layer and a-SiN layer are formed by ECR method in accordance with the present invention, the film-forming process of the present invention is free from generation of any polymer powder. Additionally the deposition rate may be increased and the gas utilization efficiency may also be improved. Accordingly, the manufacture cost of providing the photosensitive member for electrophotography of the present invention is low.

While the invention has been described in detail and with reference to specific embodiments thereof, it will be apparent to one skilled in the art that various changes and modifications can be made therein without departing from the spirit and scope thereof.

What is claimed is:

1. A photosensitive member for electrophotography comprising a photoconductive layer formed on an electroconductive support, in which the photoconductive layer includes an amorphous silicon germanium layer formed by electron cyclotron response (ECR) and containing hydrogen and/or halogen in the range of 40 at.% to 65 at.% and an amorphous silicon nitride layer formed by ECR and containing hydrogen and/or halogen in the range of 40 at.% to 60 at.%, the amorphous silicon nitride layer being laminated on the amorphous silicon germanium layer.

2. The photosensitive member for electrophotography as in claim 1, in which the amorphous silicon germanium layer contains hydrogen and/or halogen in the range of 40 at.% to 55 at.%.

3. The photosensitive member for electrophotography as in claim 1 or 2, in which the amorphous silicon germanium layer contains germanium in the range of 5.3 to 150 at.%.

4. The photosensitive member for electrophotography as in claim 3, in which the amorphous silicon germanium layer contains germanium in the range of 18 to 82 at.%.

5. The photosensitive member for electrophotography as in claim 4, in which the amorphous silicon germanium layer contains germanium in the range of 43 to 67 at.%.

6. The photosensitive member for electrophotography as in claim 1, in which the germanium concentration distribution in the amorphous silicon germanium layer is uniform along the direction of the thickness of the layer.

7. The photosensitive member for electrophotography as in claim 1, in which the germanium concentration distribution in the amorphous silicon germanium layer is so inclined that the germanium content is larger toward the side of the support.

8. The photosensitive member for electrophotography as in claim 1, in which the amorphous silicon nitride layer contains hydrogen and/or halogen in the range of 40 at.% to 55 at.%.

9. The photosensitive member for electrophotography as in claim 1, in which the amorphous silicon nitride layer contains nitrogen in the range of 0.1 to 40 at.%.

10. The photosensitive member for electrophotography as in claim 1, in which an interlayer is provided between the photoconductive layer and the electroconductive support.

11. The photosensitive member for electrophotography as in claim 10, in which the interlayer is a-Si, a SiC, a SiN or a-SiO layer as optionally doped with boron or phosphorus.

12. The photosensitive member for electrophotography as in claim 1, in which a light-transmitting surface protective layer is provided over the photoconductive layer.

13. The photosensitive member for electrophotography as in claim 12, in which the light-transmitting surface-protective layer is a-SiC, a-SiN or a-SiO layer.

14. The photosensitive member for electrophotography as in claim 1, in which the thickness of the amorphous silicon germanium layer is in the range of 0.1 to 10 microns.

15. The photosensitive member for electrophotography as in claim 1, in which the thickness of the amorphous silicon nitride layer is in the range of 1 to 50 microns.

16. A method for making a photosensitive electrophotography member comprising: forming a photoconductive layer on an electroconductive support, in which the photoconductive layer is composed of an amorphous silicon germanium layer formed by electron cyclotron resonance (ECR) and containing hydrogen and/or halogen in the range of 40 at.% to 65 at.% and an amorphous silicon nitride layer formed by ECR and containing hydrogen and/or halogen in the range of 40 at.% to 60 at.%, the amorphous silicon nitride layer being laminated on the amorphous silicon germanium layer.

17. The method of claim 16 in which the amorphous silicon germanium layer contains hydrogen and/or halogen in the range of 40 at.% to 55 at.%.

18. The method of claim 16 or 17 in which the amorphous silicon germanium layer contains germanium in the range of 5.3 to 150 at.%.

19. The method of claim 18 in which the amorphous silicon germanium layer contains germanium in the range of 18 to 82 at.%.

20. The method of claim 19 in which the amorphous silicon germanium layer contains germanium in the range of 43 to 67 at.%.

21. The method of claim 16 in which the germanium concentration distribution in the amorphous silicon germanium layer is uniform along the direction of the thickness of the layer.

22. The method of claim 16 in which the germanium concentration distribution in the amorphous silicon germanium layer is so inclined that the germanium content is larger toward the side of the support.

23. The method of claim 16 in which the amorphous silicon nitride layer contains hydrogen and/or halogen in the range of 40 at.% to 55 at.%.

24. The method of claim 16 in which the amorphous silicon nitride layer contains nitrogen in the range of 0.1 to 40 at.%.

25. The method of claim 16 in which an interlayer is provided between the photoconductive layer and the electroconductive support.

26. The method of claim 25 in which the interlayer is a-Si, A-SiC, a-SiN or A-SiO layer as optionally doped with boron or phosphorus.

27. The method of claim 16 in which a light-transmitting surface-protective layer is provided over the photoconductive layer.

28. The method of claim 27 in which the light-transmitting surface-protective layer is a-SiC, a-SiN or a-SiO layer.

29. The method of claim 16 in which the thickness of the amorphous silicon germanium layer is from 0.1 to 10 microns.

30. The method of claim 16 in which the thickness of the amorphous silicon nitride layer is from 1 to 50 microns.

* * * * *